US007364162B2

(12) United States Patent
Patelidas

(10) Patent No.: US 7,364,162 B2
(45) Date of Patent: Apr. 29, 2008

(54) POKER-TYPE CARD GAME METHOD

(75) Inventor: Antonio Patelidas, Las Vegas, NV (US)

(73) Assignee: New Poker Championships, LLC, Las Vegas, NV (US)

( * ) Notice: Subject to any disclaimer, the term of this patent is extended or adjusted under 35 U.S.C. 154(b) by 120 days.

(21) Appl. No.: 11/228,053

(22) Filed: Sep. 19, 2005

(65) Prior Publication Data

US 2007/0063440 A1 Mar. 22, 2007

(51) Int. Cl.
*A63F 1/00* (2006.01)

(52) U.S. Cl. ..... 273/292; 273/274

(58) Field of Classification Search ..... 273/292, 273/274, 309; 463/13, 12
See application file for complete search history.

(56) References Cited

U.S. PATENT DOCUMENTS 4,861,041 A * 8/1989 Jones et al. ..... 273/292
6,467,771 B1 * 10/2002 deKeller ..... 273/274
6,651,983 B1 * 11/2003 Chobanian ..... 273/292

OTHER PUBLICATIONS

"Lame-brain Pete", http://web.achive.org/web/20040731205334/http://en.wikipedia.org/wiki/Community_card, Jul. 31, 2004.*

"Lame Brain Pete Poker", http://web.archive.org/web/20030402095616/http://www.gambling-poker.com/lame_brain_pete_poker.html, Apr. 2, 2003.*

* cited by examiner

*Primary Examiner*—Benjamin H Layno
(74) *Attorney, Agent, or Firm*—Craig Weiss; Harry M. Weiss; Weiss & Moy, P.C.

(57) ABSTRACT

A poker-type game capable of providing players with an exciting alternative to Texas Hold'em and Omaha in which four community cards are dealt, eliminating the effect of the river card. Preferably, in the poker-type card game each player is dealt three playing cards from which at least one must be used in combination with at least two of four community cards to form a best five-card poker hand.

11 Claims, No Drawings

POKER-TYPE CARD GAME METHOD

FIELD OF THE INVENTION

This invention relates generally to card games and methods therefor and, more particularly, to a poker-type card game which combines some of the advantages of the popular card games Texas Hold'em and Omaha but without disadvantages common to both games.

BACKGROUND OF THE INVENTION

The card game of poker, with its many variations, has become an extremely popular form of entertainment. Poker is now a common social pastime for both gamblers and non-gamblers. The general aim of poker is to either collect a five card hand that is better than the five card hand of one or more opponents, or to try to bet in such a way as to cause, opponents to believe that their hand is inferior and subsequently "fold" (concede or turn in) their hand. Typically, the game of poker involves several players competing against one another for one cumulative "pot" or sum of money. In casinos, the dealer or "house" draws a percentage, otherwise known as "the rake", of each pot, thus generating revenue regardless of which player wins each hand.

Two of the most popular poker games are Texas Hold'em and Omaha. In Texas Hold'em, each player receives an initial hand of two cards. Typically, there is a betting round followed by the dealing of three community cards face-up, known as "the flop." After another betting round, a fourth community card, known as "the turn" is dealt face-up. After yet another round of betting, the final community card, known as "the river" is dealt face-up. After the river, there is a final round of betting, assuming two or more players remain in the game. In Texas Hold'em, a player may use any combination of the two initial cards dealt to each player and the five community cards to form the best five-card poker hand. In fact, in Texas Hold'em, it may be possible to use neither of the two cards dealt to the player, and form a best five-card hand solely from the five community cards.

In Omaha, each player receives four playing cards, rather than two as in Texas Hold'em. The community card distribution and betting structure remain the same. In Omaha, however, each player must use exactly two cards out of the four they initially receive in combination with exactly three of the five community cards to form their best five-card hand. Omaha therefore lacks the flexibility of Texas Hold'em when it comes to forming a best five card poker hand. However, Omaha does provide for more numerous and therefore exciting opportunities to form a best five-card hand, as there are a total of nine playing cards to choose from, as opposed to the seven in Texas Hold'em.

The final card dealt up, the "river", which is a common component of both Texas Hold'em and Omaha, can often have a major impact on the outcome of the game. This powerful dimension of Texas Hold'em and Omaha is both relished and despised by many a poker player. Since "the river" can "make you or break you", there are those who would prefer to play the game of poker without the potential impact of a "river" card, making do with the remaining community cards.

Therefore, both Texas Hold'em and Omaha offer separate, but intriguing benefits to poker players, while each game also has certain limitations that may make it less intriguing to different types of poker players.

A need therefore existed for providing a new, exciting variation of poker that provides players with only four community cards, thereby eliminating the "river" card, while at the same time, providing each player with three initial cards from which at least one must be used in combination with the four community cards.

SUMMARY OF THE INVENTION

An object of the present invention is to provide an improved poker card game similar to Texas Hold'em and Omaha, but with four community cards, instead of the usual five.

It is a further object of the present invention to provide an improved card game having three playing cards dealt to each player from which at least one card must be used in combination with at least two of four community playing cards that are dealt face-up.

BRIEF DESCRIPTION OF THE PREFERRED EMBODIMENTS

In accordance with one embodiment of the present invention, a method of playing a poker-type card game is disclosed, comprising, in combination the steps of dealing three cards to at least one player, dealing a first group of three community cards face-up, dealing a final community card face-up, and determining a best five-card poker hand for each said at least one player when more than one player remains in said poker-type card game, said best five-card poker hand comprising at least one of said three cards dealt to each said at least one player and at least two cards dealt from said first group of three community cards and said final community card.

In accordance with another embodiment of the present invention, a method of playing a poker-type card game is disclosed, comprising, in combination the steps of dealing three cards to at least one player, collecting at least one wager from at least one player, dealing a first group of three community cards face-up, permitting at least one player to make a second wager, dealing a final community card face-up, permitting at least one player to make a third wager, determining a best five-card poker hand for each said at least one player when more than one player remains in said poker-type card game, said best five-card poker hand comprising at least one of said three cards dealt to each said at least one player and at least two cards dealt from said first group of three community cards and said final community card, comparing a best five-card poker hand of one player to a best five-card poker hand of at least one other player when more than one player remain in said poker-type card game, and determining a winning five-card poker hand between at least one player and at least one other player, wherein a winning five-card poker hand having a higher poker value than a five-card poker hand of any other player.

In accordance with yet another embodiment of the present invention, a method of playing a poker-type card game is disclosed, comprising, in combination the steps of dealing at least two cards to at least one player, dealing a first group of three community cards face-up, dealing a final community card face-up, and determining a best five-card poker hand for each said at least one player when more than one player remains in said poker-type card game, said best five-card poker hand comprising any combination of said at least two cards dealt to each said at least one player and said first group of three community cards and said final community card.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

The present invention comprises a method of playing a poker-type card game having many of the attributes of popular poker games such as Texas Hold'em and Omaha, but with other distinct advantages. The first step in the method is dealing at least two cards, and preferably three cards, to each player playing the game. Preferably, as in Texas Hold'em and Omaha, a standard betting structure, such as the "big blind" and "small blind," would be used to establish the minimum bet by which any player must call to remain in the game. If more than one player remains in the game after the first round of betting, three community cards, known as "the flop" are dealt face-up preferably in the center of a poker table. If more than one player remains in the game after another round of betting, then a fourth and final community card is dealt face-up. If, after a final round of betting more than one player remains in the game, then a showdown occurs between two or more players in which each remaining player's hand is compared to another's whereby the hand having the highest poker value is a winning hand. In the preferred embodiment, in which each player received three playing cards, each player forms a best five-card hand by combining at least one of the three initial playing cards dealt to the player with at least two of the four community cards dealt face-up. While, in the preferred embodiment, each player is dealt three cards from which at least one and as many as all three must be combined with at least two and as many as four community cards, it should be clearly understood that substantial benefit could be derived from an alternative embodiment of the present invention in which two cards are dealt to each player with or without restriction on the number of cards must be used, or in which three cards are dealt to each player but without restriction as to the number of cards that must be used, or in which three cards are dealt to each player and at least two cards must be used, so long as there are four community cards.

While, in the preferred embodiment, the poker-type card game of the present invention is played at a casino with a betting structure that allows players to wager, it should be clearly understood that substantial benefit could be derived from an alternative embodiment of the present invention in which there is an alternative betting structure, or no wagering at all. For example, if this poker-type card game were to be played on a video gaming machine, over the internet, or against a computer, it may be beneficial to have a different betting structure, no wager at all, or a single wager that would allow the player to qualify for a payout if his or her hand corresponded to a pre-determined poker value.

I claim:

1. A method of playing a poker-type card game comprising, in combination, the steps of:

initially dealing cards consisting of three cards face down to at least one player;

subsequently dealing a first group of three community cards face-up, and not permitting the placing of any wager during the time the first group of three community cards are dealt;

dealing a final card which is a fourth community card face-up; and determining a best five-card poker hand for each said at least one player when more than one player remains in said poker-type card game, said best five-card poker hand comprising at least one of said three face down cards initially dealt to each said at least one player and at least two cards dealt from said first group of three community cards and said final and fourth community card.

2. The method of claim 1 further comprising the step of permitting said at least one player to place at least one wager.

3. The method of claim 2 further comprising the step of collecting said at least one wager from said at least one player.

4. The method of claim 3 further comprising the step of paying said at least one player a percentage of all wagers collected from each said at least one player when said at least one player being at least one of a last remaining player and a player having a best five-card poker hand.

5. The method of claim 1 further comprising the steps of:

comparing a best five-card poker hand of one player to a best five-card poker hand of at least one other player; and determining a winning five-card poker hand between at least one player and at least one other player, wherein a winning five-card poker hand having a higher poker value than a five-card poker hand of any other player.

6. The method of claim 5 further comprising the step of permitting at least one player to place at least one wager that a five-card poker hand of said at least one player will correspond to a pre-determined poker value.

7. The method of claim 6 further comprising the step of collecting from each said at least one player said at least one wager.

8. The method of claim 1 further comprising the step of permitting a player to be eligible to receive a pre-determined payout if said five-card poker hand of said at least one player corresponds to a pre-deterinined poker value.

9. The method of claim 8 further comprising the step of paying each said at least one player a pre-determined payout when said five-card poker hand of said at least one player corresponds to a pre-determined poker value.

10. A method of playing a poker-type card game comprising, in combination, the steps of:

initially dealing cards consisting of three cards face down to at least one player;

collecting at least one wager from at least one player;

subsequently dealing a first group of three community cards face-up, and not permitting the placing of any wager during the time the first group of three community cards are dealt;

permitting at least one player to make a second wager;

dealing a final card which is a fourth community card face-up;

permitting at least one player to make a third wager;

determining a best five-card poker hand for each said at least one player when more than one player remains in said poker-type card game, said best five-card poker hand comprising at least one of said three face down cards initially dealt to each said at least one player and at least two cards dealt from said first group of three community cards and said final and fourth community card;

comparing a best five-card poker hand of one player to a best five-card poker hand of at least one other player when more than one player remain in said poker-type card game; and determining a winning five-card poker hand between at least one player and at least one other player, wherein a winning five-card poker hand having a higher poker value than a five-card poker hand of any other player.

11. A method of playing a poker-type card game comprising, in combination the steps of:

initially dealing cards consisting of three cards face down to at least one player;

subsequently dealing a first group of three community cards face-up, and not permitting the placing of any wager during the time the first group of three community cards are dealt;

dealing a final card which is a fourth community card face-up; and determining a best five-card poker hand for each said at least one player when more than one player remains in said poker-type card game, said best five-card poker hand comprising any combination of said at least two cards dealt to each said at least one player and said first group of three community cards and said final and fourth community card.

* * * * *